US005211322A

United States Patent [19]

Nealy

[11] Patent Number: 5,211,322

[45] Date of Patent: May 18, 1993

[54] SECURITY SHEATH FOR KNIVES

[76] Inventor: Charles V. Nealy, 822 Thomas St., Stroudsburg, Pa. 18360

[21] Appl. No.: 665,685

[22] Filed: Mar. 7, 1991

[51] Int. Cl.[5] ..... B26B 29/02

[52] U.S. Cl. ..... 224/232; 224/230; 224/242; 30/151

[58] Field of Search ..... 224/232, 233, 230, 242, 224/245; 30/151, 152, 153, 296.1, 297, 298, 298.4

[56] References Cited

U.S. PATENT DOCUMENTS

| | | | |
|---|---|---|---|
| 1,148,369 | 7/1915 | Farmer | 224/242 |
| 1,553,066 | 9/1925 | Burger | 224/342 |
| 1,605,359 | 11/1926 | Louret | 224/232 |
| 2,527,710 | 10/1950 | Davidson | 30/151 |
| 2,527,711 | 10/1950 | Davidson | 30/151 |
| 2,783,536 | 3/1957 | McQuery | 30/151 |
| 2,793,434 | 5/1957 | Wigington | 30/151 |
| 3,307,756 | 3/1967 | Brunosson et al. | 224/232 |
| 3,381,807 | 5/1968 | De Vaughn | 30/162 |
| 3,797,717 | 3/1974 | Collins | 224/230 X |
| 4,122,984 | 10/1978 | Russell | 224/232 X |
| 4,211,003 | 7/1980 | Collins | 224/232 X |
| 4,263,714 | 4/1981 | Todd, Sr. | 30/151 |
| 4,494,309 | 1/1985 | Gray | 30/156 X |
| 4,726,498 | 2/1988 | Esposito | 30/151 X |
| 4,835,863 | 7/1989 | Salandre | 224/232 X |
| 4,854,044 | 8/1989 | Collins | 30/151 |
| 4,916,815 | 4/1990 | Ohmura | 30/151 |
| 4,942,663 | 7/1990 | Ray, Sr. | 224/232 X |
| 4,964,554 | 10/1990 | Collins | 224/232 |
| 5,002,213 | 3/1991 | Newton | 224/232 |
| 5,031,810 | 7/1991 | Finn et al. | 224/242 X |

OTHER PUBLICATIONS

Pp. 46 and 47 of the Jan./Feb. 1989 issue of "The Blade Magazine", article entitled The Wonder Material for Sheaths-Kydex ® by Gary Kelley.

Spring 91 "Fighting Knives" said article being entitled The Perfect Shoulder Carry by Greg Walter.

*Primary Examiner*—Henry J. Recla

*Assistant Examiner*—Glenn T. Barrett

*Attorney, Agent, or Firm*—O'Keefe & Wilkinson

[57] ABSTRACT

A thermoplastic molded sheath for a knife grips the knife tightly to prevent accidental loss or withdrawal. The security of such grip is sufficient to enable the knife to be carried in the sheath in an inverted position upon the body of the wearer. The sheath is made by thermoforming a rigid yet resilient thermoplastic about a knife blade having the exact dimensions of the blade which is to be carried within the sheath. The thermoformed sheath may be attached at its bottom to a pocket-sized semirigid pocket-retaining clip, which clip, when inserted into a pocket, supports the sheath in an inverted position with the blade of the knife extending upwardly and the hilt of the knife in a convenient position for drawing from the sheath. The combination of the orientation of the sheath and the pocket retaining clip places a minimum stress upon a pocket and is comfortable to wear. An additional spring clip arrangement, preferably attained by thermomolding the sheath about an inverted dimension bolster at the bottom of the handle of the knife provides additional security to the knife in its inverted carrying position.

9 Claims, 5 Drawing Sheets

FIG. 1
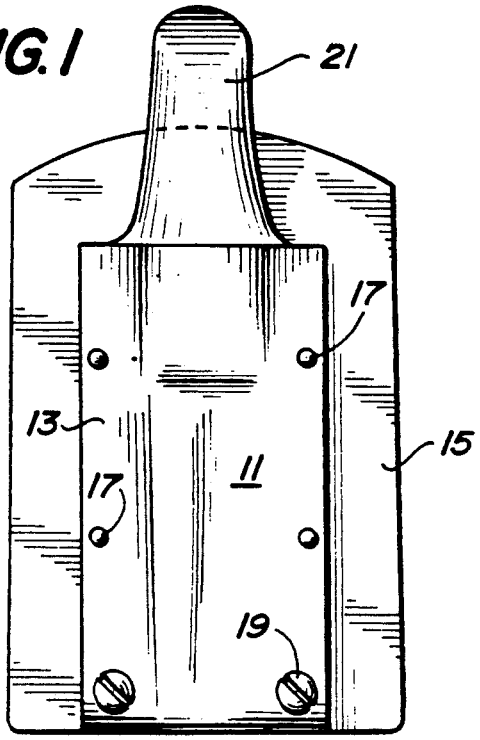
FIG. 2
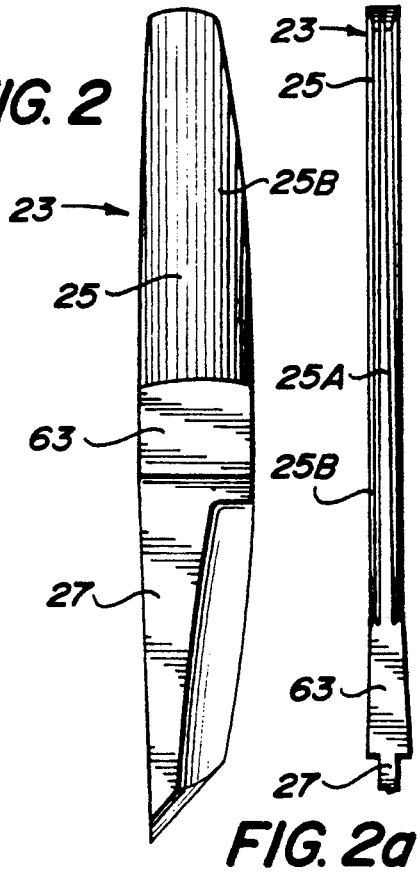
FIG. 2a
FIG. 3
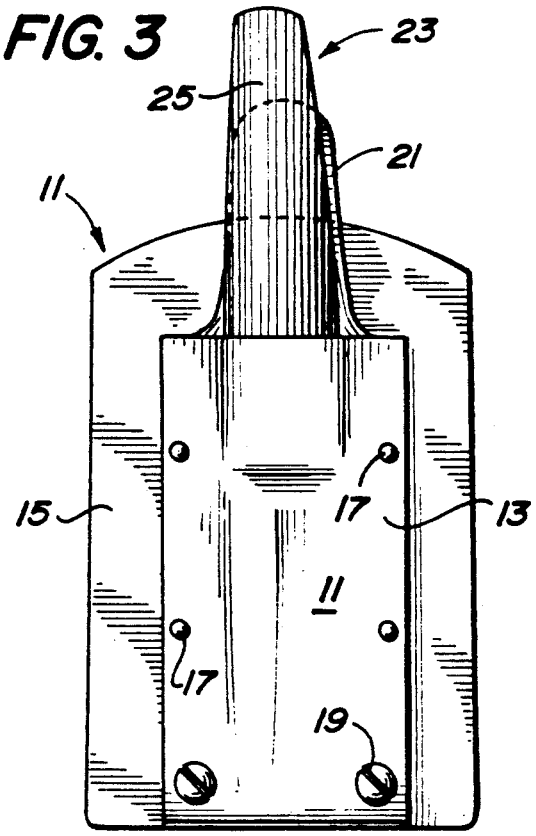
FIG. 4
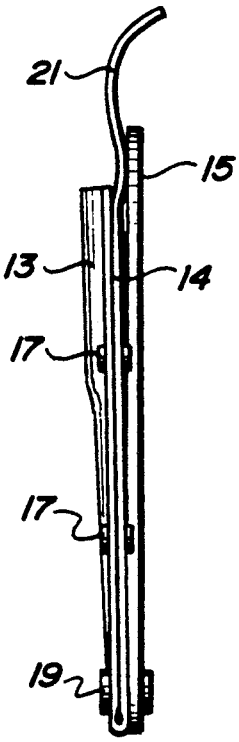
FIG. 5
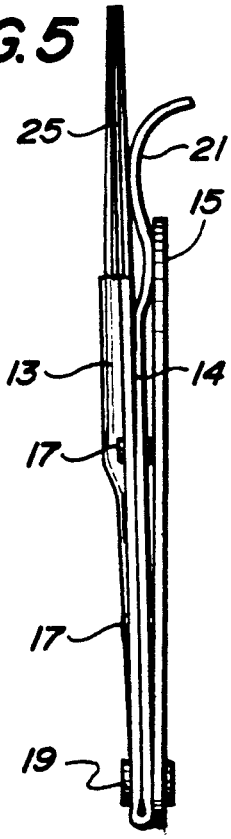

SECURITY SHEATH FOR KNIVES

BACKGROUND OF THE INVENTION (1) Field of the Invention

This invention relates to sheaths for knives and more particularly to a sheath in which the knife is held securely in the sheath so that it will not be accidentally lost or displaced. More particularly still, the present invention relates to a sheath-and-knife combination in which the knife may be carried in an inverted position without accidental or unwanted separation from the sheath and provides a particularly useful pocket clip which conveniently suspends the knife in an inverted position from a pocket.

(2) Description of the Prior Art

Knives are often carried on the person for various purposes such as in the field during hunting and military operations and occasionally in pockets for personal use or defense. It is customary to carry a knife in a sheath not only to have the knife readily available for use when wanted, but also to protect both the knife from the environment, which, if in contact with the blade, might dull the blade, and to protect the person carrying or handling the knife from the sharp edge or point of the knife. It has been known in the art to provide various types of locking devices whereby a knife may be interengaged with the sheath through some active detent or the like to prevent the knife from being lost from the sheath. A representative sample of sheath arrangements making use of various means for interlocking a knife and the sheath or otherwise holding a knife in the sheath are disclosed in the following U.S. Patents:

U.S. Pat. No. 1,605,359 to Louret
U.S. Pat. No. 2,527,711 to Davidson
U.S. Pat. No. 2,793,434 to Wigington
U.S. Pat. No. 4,726,498 to Esposito
U.S. Pat. No. 4,854,044 to Collins
U.S. Pat. No. 4,942,663 to Ray While the various means and mechanisms for retaining a knife in a sheath disclosed in the above-noted patents have been effective so far as they go, they have had certain disadvantages, one of the major of which is the usual necessity to operate a catch or detent in order to release the knife. Operation of such catch or detent requires a familiarity with the particular detent mechanism by the user of the knife plus sufficient time and practice to quickly and efficiently effect the release of the knife from the sheath, particularly when quick use of the knife is desirable.

In addition to the inconvenience of having to operate a specific release to remove a knife from its sheath, particularly when such knife may be desired to be drawn from its sheath quickly, the usual sheathing of a knife with the hilt of the knife upright and the sheath attached to the belt requires the hand of the knife carrier to be bent at an inconvenient angle in order to draw the knife with a conventional grip on such knife for normal use. The hand grip required for normal use positions the knife with the blade protruding from the front of the hand in a position such that an effective "power grip" is attained on the hilt of the knife. Such power grip enables the knife to extend transversely from the hand with the fingers and thumb curled around the hilt from opposite directions and the hand essentially closed as in grasping any elongated object. The knife can be easily and quickly shifted from the power grip to a so-called "fine controlled grip" in which the knife instead of being gripped with the fingers and thumb curled about the hilt, lies in the palm across the fingers which are only partially curled about the knife hilt while the thumb is pressed against the side of the hilt or even the upper part of the blade in a position such that fine and delicate movements can be made with the knife blade while it is essentially being used as a tool, for example, for paring food, cleaning or skinning animals, and other uses.

It is almost impossible to quickly shift the hilt of a knife in ones hand from the conventional "dagger grip" in which the hilt of the handle is again held with the fingers and the thumb curled about the hilt, but in which the blade of the knife extends from the bottom or heel of the hand rather than from the top of the hand near the thumb. As will be recognized, however, in the case of a knife held in a sheath at about the level of the waist or even higher with the hilt projecting upwardly, the dagger grip is the only grip which is conveniently taken upon the hilt of the knife. This is particularly so if the knife is carried on the belt or the like in the front of the body, where it is safest from removal surreptitiously by third parties, unless the hand of the owner is twisted when drawing the knife at a somewhat or even decidedly inconvenient angle. This is one of the reasons why knives such as bowie knives or hunting knives are so frequently carried in sheaths attached to a belt with the sheath positioned at the side or in the back of the body of the wearer. It is necessary in such positions to stretch the arm in reaching for the knife and the arm thereby assumes a position in which the hand is more or less automatically brought into an orientation where the most natural grip to obtain upon the hilt of the knife is with the knife gripped in a semi-power position with the blade upright and extending from between the fingers and the thumb. It is often convenient, however, to carry a knife attached to the person in the front of the body. Front carriage of a knife is desirable particularly when a coat of some type is to be worn over the knife or when it is desired to conceal the knife, yet allow for quick removal for defense or other purposes.

U.S. Pat. No. 4,211,003 issued Jul. 8, 1980 to W. W. Collins discloses a knife which is actively interengaged with a detent on a sheath to maintain the knife in the sheath even when the knife is inverted. FIG. 1 of the Collins patent shows a knife retained by a detent interlocked between the knife and the sheath with the sheath held on a shoulder harness in an inverted position allowing the knife to be grasped immediately in the power position orientation and withdrawn downwardly out of the sheath to quickly remove the knife from the sheath. Unfortunately, the knife, although in a convenient position for quick withdrawal, still has to be disengaged from the detent on the upper portion of the sheath, which disengagement at best takes time and at the worse, may completely foil the drawing of the knife under stressful conditions when one is trying to effect a quick withdrawal.

U.S. Pat. No. 4,494,309 issued Jan. 22, 1985 to R. A. Gray discloses a jam-type sheath for a switchblade-type knife. Two sides of the sheath, which is in the form of a rectangular box, are compressed against the sides of the knife handle so that when the hand of the user grips the end of the knife at the top of the blade and pulls, the knife automatically partially opens and then with a further outward force, the handle of the knife is slid out of the compression detent arrangement allowing the knife to be then shifted in the hands so that the hand grips the handle rather than the blade of the knife. While the Gray patent, therefore, discloses a jam-type retention of a knife within a knife holder, it does not provide a convenient method of carrying anything but a switchblade knife.

The present applicant is also aware that for many years it has been the custom to shrink leather gun holsters and knife sheaves over guns and knives by thoroughly wetting the leather and allowing it to dry in contact with the gun or knife in order to attain a tighter and more retentive fit. Unfortunately such shrink fitting is not effective for very long since the leather rather quickly stretches and losses it tautness, usually within a matter of days.

The applicant is also aware of a prior use of stiff thermoplastic material including his preferred material of construction for his sheath in connection with the retention of a knife in such sheath by forming upon the surface of the knife blade small depressions or dimples, usually near the top of the blade with a further gripping of the blade fairly tightly between the sheath panels at the bottom of the sheath. Steps were also taken to prevent intimate contact of the intermediate portion of the knife blade with the intermediate portion of the sheath. While relatively effective, the expedient of forming depressions in the blade is undesirable as it mars the surface of the knife making it less desirable, particularly for collectors, and thus decreasing its market value and the dimples must be either rather large or else the knife seated rather exactly in the sheath in order to make certain it is securely gripped by the sheath.

It has also been the custom to provide sheaths for knives with various loops and/or clips for attachment to belts and other portions of the dress or accouterments upon civilian or military dress. While such expedients have had varying degrees of success, there has been no really effective means for attaching a knife directly to a pocket without severely straining and in many cases tearing such pocket and rendering further accommodation of the knife impossible.

For some years also, it has been the custom to provide pocket clips for the carrying of pencils, pens, rulers and other devices in the breast pocket within a plastic or leather carrying case which essentially fills the entire pocket very often with a clip on the outside to help retain the carrier within the pocket. The fact that the case fills essentially the entire pocket together with the clips provides additional security over and above using only a clip to retain individual writing or other implements.

In addition to the above, U.S. Pat. No. 4,122,984 issued Oct. 31, 1978 to A. G. Russell discloses a sheath for a knife in which the sheath is formed into a rectangular shape generally of a size and conformation for slipping easily into and substantially filling a pocket and particularly a back pant's pocket where the knife and the sheath can be essentially hidden from view. The knife itself it seated in the sheath between two outer sheath members which enclose a slot in the main pocket entering member. In use, the entire rectangular pocket member plus a knife held within such member between adjacent outer sheath members is used only in pockets where it is placed right side up in such pocket to enable grasping of the top of the handle of the knife to be effected. The Russell arrangement, therefore, does not allow the knife to be carried on the person in an inverted position convenient for grasping by the hand of the user in a high-speed draw of the knife.

There has been a need, therefore, for a sheath-and-knife arrangement in which the sheath may be carried in an inverted position with the knife arranged in the sheath for quick grasping by the hand for withdrawal of the knife in its power position in the quickest possible manner and without any necessity to operate a catch in order to release the knife from its sheath, yet allow the knife to be retained in the sheath without an inconvenient and frequently difficult to activate mechanical interlock arrangement.

There has, furthermore, been a continuing need for a knife sheath that will securely hold a knife from accidental release from the sheath during active movements of the wearer without an inconveniently operated special catch or detent even when the knife and sheath are worn or carried in an upright, as contrasted to an inverted, position.

There has been a still further need for a means to securely support a knife from a pocket in the clothing of an individual that provides a secure retention for the sheath and the knife, is comfortable to wear, plus being inconspicuous.

OBJECTS OF THE INVENTION

It is an object of the invention, therefore, to provide a sheath arrangement for carrying a knife on the body of the user, which sheath may retain a knife during active shaking and jiggling of the sheath such as may be encountered in rough terrain and on the trail and other active movements of the human body.

It is a further object of the invention to provide a sheath in which the knife is essentially held in the sheath by a jam fit to prevent its accidental withdrawal from the sheath, yet allow the knife to be quickly and easily withdrawn from the sheath by the hand of the user.

It is a still further object of the invention to provide a plastic moldable sheath in which a knife is sufficiently held by friction or a jam fit that it will not become detached from the sheath accidentally, but will require an active tug by the hand of the user to remove the knife from the sheath.

It is a still further object of the invention to provide a sheath in which a knife is held by a jam fit sufficiently tightly so if the knife is held in an inverted position such as is desirable for a quick drawing of the knife, such knife will not become detached from such sheath except by a vigorous tug by the hand of the user upon the hilt of the knife.

It is a still further object of the invention to provide a sheath for securely maintaining a knife in said sheath with the major portion of the handle of the knife exposed for easy gripping by the hand of the user.

It is a still further object of the invention to provide a hand grip in which the knife may be maintained in an inverted position in a sheath for quick withdrawal by a tug upon the hilt of the knife and without the operation of a specific catch or detent in order to effect withdrawal of the knife from the sheath.

It is a still further object of the invention to provide a knife sheath which can be conveniently attached to a pocket at the front of the body with the knife and main portion of the sheath extending in an inverted position from said pocket in which position they can be quickly grasped by the hand of the user.

It is a still further object of the invention to provide a substantially rectangular or other shaped pocket retaining member which, in combination with the sheath, enables a knife to be carried in an inverted position near the front of the body where it can be quickly withdrawn from the sheath ready to be used.

It is a still further object of the invention to provide a sheath for a knife in which the knife is at least partially retained in the sheath by means of a resilient gripping of a portion of the handle of the knife which increases in diameter opposite to the withdrawal movement of the knife.

It is a still further object of the invention to provide a means for retention of a knife in a sheath to the exterior of a pocket without damage to the pocket or the underlying clothing.

It is a still further object of the invention to provide a method for producing a sheath for a knife which may retain the blade of a knife by jam fit even when the knife is carried in an inverted position for a quick draw.

It is a still further object of the invention to provide a method for producing a knife sheath in which the sheath may be quickly and easily made by a compression molding method.

It is a still further object of the invention to provide a knife-and-sheath combination in which the knife is arranged to be withdrawn from the sheath quickly and easily in a so-called "power grip".

It is a still further object of the invention to provide a sheath for a knife in which the security of the knife in the sheath is increased by the provision of a resiliently biased flap extending upwardly from one side panel of the sheath for frictional contact with the handle of the knife.

It is a still further object of the invention to provide a two-part sheath for a knife in which a clip portion may be removed allowing the sheath proper to be secured by line or thong to the body of one carrying the knife.

Other objects and advantages of the invention will become evident by a careful study of the following description of several embodiments together with the appended drawings of the invention.

BRIEF DESCRIPTION OF THE INVENTION

This invention is directed to a plastic sheath for a knife in which the plastic is heat molded so that it closely confines the blade and/or other portions of the knife with sufficient frictional contact to prevent the blade of the knife from being withdrawn from the sheath except by a fairly vigorous outward force upon the handle of the blade. The sheath is made from a semirigid plastic material having a heat memory which material is readily deformable into a permanent retained shape by heat forming under pressure. Such heat forming is accomplished by first fabricating a sheath from semirigid panel material, securing the panel material together into the form of a sheath, heating the plastic into the thermoforming range, inserting the knife which is designed to be carried in the sheath into the sheath between the two side panels of the sheath and heat compressing the sheath about the knife. A clip or the like for supporting the sheath from the person is then secured to the sheath. The sheath may be preferably attached to a rectangular pocket-retaining clip or pocket flap means which preferably has the general shape of the pocket in which it is to be inserted or retained with the main portion of the sheath dependent downwardly on the outside of the pocket away from its attachment to the clips or retaining member. The sheath proper is preferably and conveniently fastened together at the edges by rivets or eyelets and is further fastened together and also to the pocket clip piece conveniently by the use of screw means. In a preferred arrangement or construction, the sheath incorporates a resiliently biased upward (or downward) extension at the end of one side panel which contacts and aids in resiliently holding the knife by frictionally contacting the handle of a knife inserted into the sheath and in a still further very preferred arrangement or construction, a portion of the handle of the knife to be accommodated in the sheath has on at least one side a small downwardly increasing transverse dimension which, when inserted into the semirigid resilient sheath molded to the shape of such section, serves to retain the knife in the sheath.

BRIEF DESCRIPTION OF THE DRAWINGS

FIG. 1 is a side elevation of a knife sheath formed in accordance with a preferred embodiment of this invention.

FIG. 2 is a side elevation of a preferred type of knife for use in the sheath of the invention.

FIG. 2A is an edge view of the knife of FIG. 2.

FIG. 3 is a side elevation of the sheath of FIG. 1 with the knife of FIGS. 2 and 3 inserted into such sheath.

FIG. 4 is a transverse or edge view of the sheath shown in FIG. 1.

FIG. 5 is a transverse or edge view of the knife and sheath combination shown in FIG. 3 showing, in particular, how the knife is partially and preferably retained by a resilient extension of the knife sheath.

DESCRIPTION OF THE PREFERRED EMBODIMENTS

Figure 6:
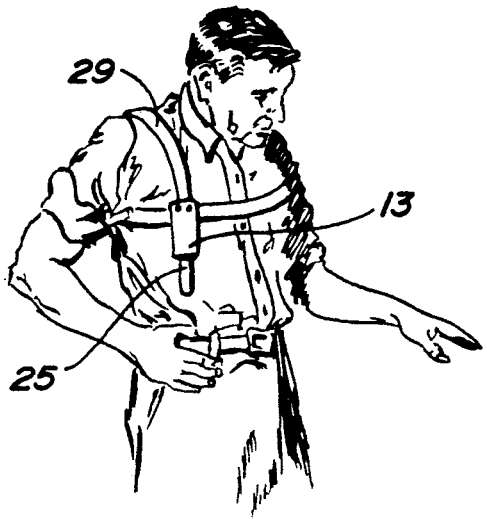
FIG. 6 is a perspective view illustrating the knife and sheath of the present invention supported in normal inverted orientation on a shoulder harness.

The present invention provides a novel method and means to retain a knife in a sheath which can be borne upon the person of someone who wishes to carry the knife either suspended from their person in a preferred inverted configuration or in an upright configuration and in either instance prevented from separation from the sheath proper by the close-fitting, heat-molded material from which the sheath is made. As explained in some detail in the discussion of the prior art above, if a knife can be held on a person's body in an inverted position near the front of the body, it can be easily and quickly grasped by the hand of the carrier in a so-called "power grip" which is the most convenient grasp for actual use of the knife and can be quickly and simply shifted over into a fine or delicate manipulation configuration in the hand of the user. The sheath of the invention enables a knife to be simply and conveniently carried in an inverted position enabling such knife to be quickly and conveniently removed or drawn from its sheath while the sheath is suspended either in a preferred inverted orientation or in an upright orientation while retaining the knife securely in its sheath until required to be unsheathed.

The invention also provides an arrangement for applying a pocket clip to a knife sheath that is simple and effective to enable a knife to be carried not in but attached to a pocket in a manner that is both comfortable and does not damage the pocket because of the arrangement and the orientation of the knife. Such pocket retention clip distributes the weight of the knife evenly to all portions of the pocket and because the knife is suspended in an inverted orientation the weight is directed downwardly rather than outwardly so that with a light knife little, if any, strain is placed upon the pocket and such knife is often hardly noticeable to the wearer.

In the figures, FIG. 1 shows an elevation of a knife sheath generally designated as 11 formed from front and back panels 13 and 14 attached together by rivets 17 and also by screw fastenings 19 which also attach the sheath to a pocket retention clip 15. One side panel 13 of the sheath 11, shown more particularly in FIG. 1, is a mirror image of the lower portion of the sheath. The other side panel 14 of the sheath may be seen in FIGS. 4 and 5 which are edge views of the sheath arrangement of the invention. It will be noted particularly in FIGS. 4 and 5 that the side 14 of the sheath has extended from its top a resilient biasing member 21 which may be biased permanently against the knife to be held in the sheath in order to efficiently and effectively hold the knife within the sheath 11. Resilient biasing member 21 may be seen also in FIGS. 1 and 3. As shown, the biasing member 21 will usually assume a curved or "S" configuration which enables it to provide a continuous biasing point contact to the knife handle at all times the knife is contained within the sheath.

FIG. 2 shows a typical knife which may be used in the sheath shown in FIGS. 1, 3, 4, and 5. Such knife 23, which has a fairly short blade 27 and a hilt or handle 25, is shown in the sheath in FIGS. 3 and 5. It will be understood that the knife shown in FIG. 3 is preferably a bare-bones or basic-type knife in which the hilt or handle is basically an extension of the metal blade and in which the knife is fairly light so that not too much weight is carried by the sheath. As shown in FIG. 2, the knife comprises a hilt 25 and the blade 27, the lower portion of the blade being ground out to provide the sharp cutting section of the knife. The upper portion of the handle 25 may desirably be provided with a black coating which may be a conventional epoxy composition containing a coloring element or other coating suitable for a knife. The lower portion of the hilt known as the bolster, may be polished metal. As will be described more fully below, preferred configurations of the hilt may be used to aid interlocking of the knife and the sheath.

While the handle of the knife could also be formed essentially of a solid metal section, the preferred knife arrangement is to have a central bolster section essentially the thickness of the original metal section from which the knife was machined with the knife blade ground or machined to a thinner section on one end and the tang of the knife upon which the handle is normally secured extending from the other side in the opposite direction. The tang is normally ground or machined down to a thinner and also very often a significantly narrower section in order to lighten the overall knife and provide a better balance between the blade and the handle. As indicated above, in the preferred knife used in the invention the tang is merely ground or machined much thinner than the bolster of the knife and the excess metal removed is then filled in with an epoxy-type handle or coating composition and then shaped to its final form. This forms a well balanced, pleasing knife of small and practical dimensions.

In addition, the present inventor has discovered that if the sides of the bolster of the handle, i.e. the portion that has not been ground or machined down to provide a lighter handle and to provide a center balance between the handle and the blade, is formed with a downward expansion or, in other words, an upward taper and the sheath is designed to slip over this portion that, as will presently be described, when the proper sheath material is used, the sheath will very securely grip the knife and the bolster and permanently retain the knife in the sheath against all normal gravitational and inertial forces, even though the taper upon the bolster is substantially unnoticeable, except by the use of very accurate measuring instruments, such as calipers, even a micrometer or the like.

Figure 13:
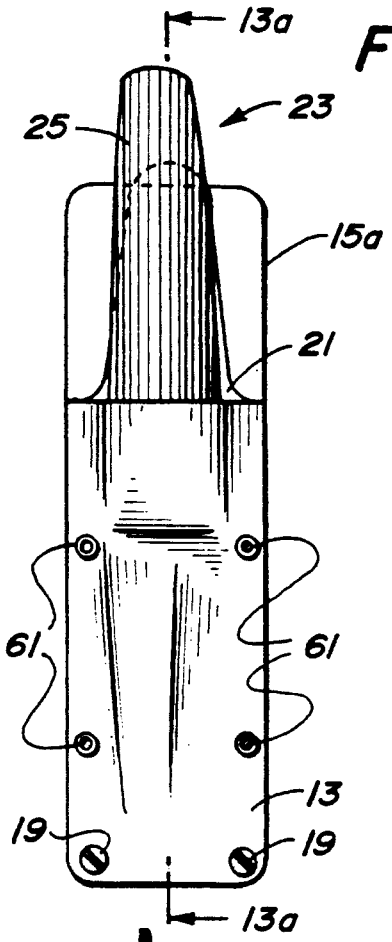
FIG. 13 is a side elevation of an embodiment of the sheath of the invention in which the pocket plate of the sheath is only as wide as the sheath and the upper portion of the sheath is fastened together with eyelets rather than with rivets.

FIG. 2*a* is an enlarged edge view of the handle portion of the knife shown in FIG. 2, inserted into the sheath in FIG. 13. In FIG. 2*a* it will be seen that the bolster portion 63 of the handle 25 of the knife 23 is downwardly expanded so that it gradually becomes larger from the top to the bottom of the bolster. The side of the bolster, in other words, has a slight outward inclination away from the longitudinal axis of the knife. This may be so particularly on one side and especially on the side which will face outwardly in the sheath, i.e. in this case the left side of the knife which, as shown in FIGS. 3 and 5 by the outline of the knife molded into the side of the sheath, will usually be the outside of the knife as accommodated in the sheath. This downwardly increasing bolster portion 63 of the knife, when inserted into the sheath to which it has been exactly molded, becomes locked into the sheath which must be moved outwardly to allow the expanded portion of the bolster to pass in either inserting or withdrawing the knife.

FIG. 6 shows a variation of a knife-and-sheath combination of the invention carried in a shoulder-harness arrangement with the hilt 25 of the knife inclined downwardly where, since the shoulder-strap arrangement is on the right side of the user's body, the handle 25 may be easily and quickly grasped by the left hand of the wearer. The illustration of a left-handed shoulder harness arrangement is for convenience in illustration only, and it will be understood that a right-handed shoulder harness could just as conveniently be provided.

Figure 7:
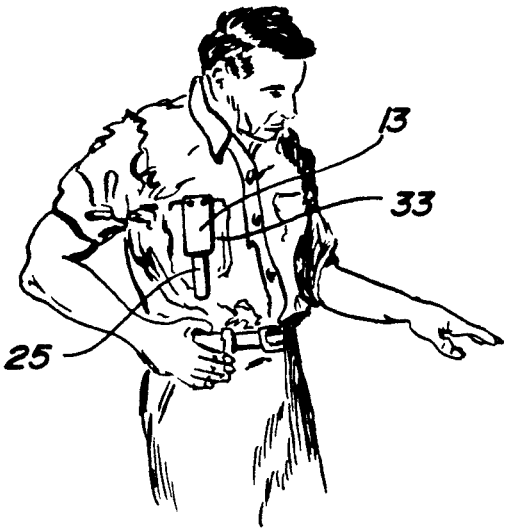
FIG. 7 is a perspective view of the preferred knife and sheath of the invention shown in FIGS. 3 and 5 suspended from a front pocket of the cloths of a human figure.
Figure 8:
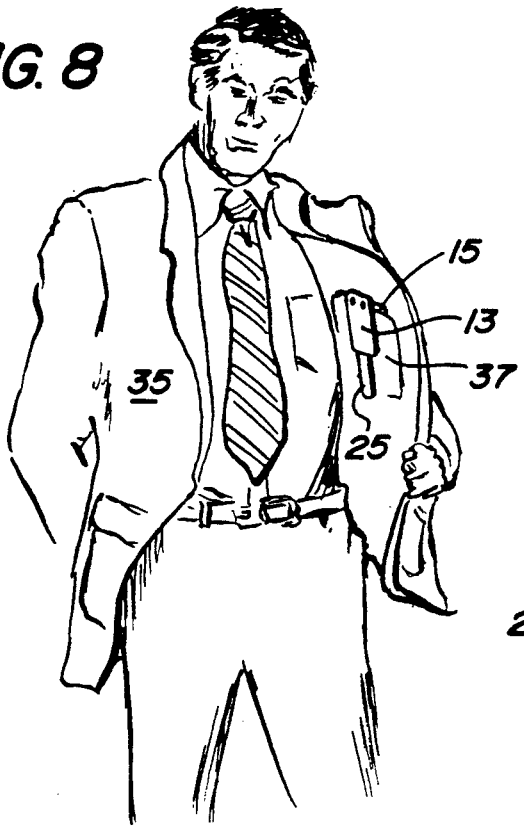
FIG. 8 is a perspective view of the embodiment of the knife and sheath shown in FIGS. 3 and 5 clipped to the inside pocket of a coat worn by a human figure.

The pocket retention clip 15 normally attached to the sheath 11, as shown in FIGS. 1 and 3, is normally significantly larger transversely than the sheath 11 and is designed to fit into the average sized shirt pocket or inside coat pocket while substantially filling such pocket transversely and preferably also vertically. See in this regard FIGS. 7 and 8 hereinafter described. By substantially filling the pocket into which the knife pocket retention clip is inserted, stabilization of both the retention clip and the sheath to which it is connected is attained and movement of the knife is substantially limited so that carrying of the knife is rendered substantially more comfortable and wear upon the pocket is decreased. However, it is not only the filling of the pocket that is important, but also the fact that the knife is dependent from the pocket in an inverted orientation, as shown in FIGS. 7 and 8, not only placing the knife in a position for convenient grasping or drawing in a "power grip", but also placing the balance of the knife below the pocket so that all the force upon the pocket is downward rather than outward, as would be the case if the knife was upright. The orientation of the knife handle downwardly, furthermore, also prevents the upper portion of the knife and the sheath from pulling outwardly away from the body, since this would requires tilting of the knife from a vertical position so that the handle is biased against the body of the wearer maintaining the knife in an upright position and its weight directed substantially directly downwardly within the pocket. It is an advantage if the pocket retention clip 15 reaches the bottom of the pocket so that some or all of the weight is taken directly by the bottom of the pocket where it is strongest. However, this may require the provision of a custom made pocket retention clip fabricated with dimensions to fit the particular pocket and provision of such a clip may not always be convenient, particularly as the pocket retention clip should also not extend upwardly too far beyond the top of the pocket to the point where it is secured to the sheath. However, it has been found that even where the pocket retention clip extends only most of the way down into the pocket, but does not reach the bottom and the weight of the knife and sheath is therefore retained largely by the top edge of the pocket upon which the fastenings at the bottom (or, when inserted into the pocket, the top) of the sheath are secured to the pocket retention clips, the balance, weight and configuration of the entire assembly is such that no undue strain or force is placed upon such pocket by the knife and sheath combination and the entire assembly is extremely comfortable and convenient to wear.

FIG. 7, as indicated above, shows an alternative and preferred arrangement for carrying a knife in which the sheath shown in FIGS. 1, 3, 4, and 5 is inserted in the pocket of a shirt and particularly the breast pocket of such shirt allowing the handle of the knife to extend downwardly along the front of the shirt in a position to be grasped by the left hand of the wearer simply and easily, or, as will be noted, if the knife is worn openly, i.e. not under a coat or the like, also conveniently by the right hand. As noted with respect to FIG. 6, the knife could also be worn on the left side and grasped with the right hand in a cross breast draw motion.

FIG. 8 shows a still further alternative mode of carrying the knife in which a coat is provided with an inside pocket 37 over the top of which the upper portion of the pocket retention clip 15 projects allowing the sheath proper 13 to extend downwardly along the face of the pocket with the hilt 25 of the knife extending still further downwardly in a position to be easily grasped, in this case, by the right hand of the user after throwing open the front of the coat as shown, or alternatively, by slipping the hand under the inside of the coat. As shown, it is desirable for the pocket retention clip to substantially fill the pocket in order to completely stabilize the knife sheath in the inside of the coat. Such stabilization decreases the potentiality for the pocket retention clip to jounce out of the pocket.

Figure 9:
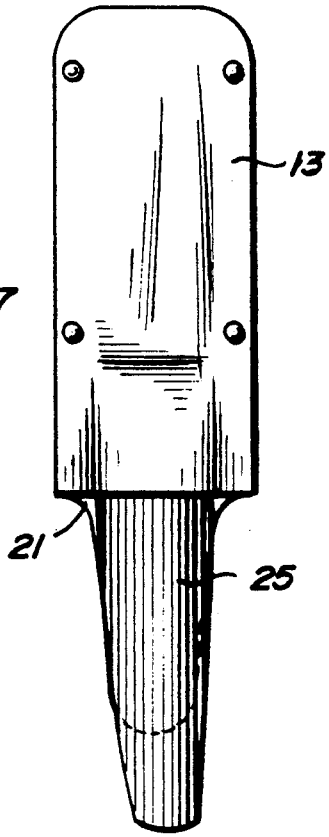
FIG. 9 is a side elevation of an alternative embodiment of the knife and sheath combination of the invention in which the sheath is provided with a biasing or spring-type clip for attachment to a pocket or other upwardly facing edge of clothing or other accouterments of the human body.
Figure 10:
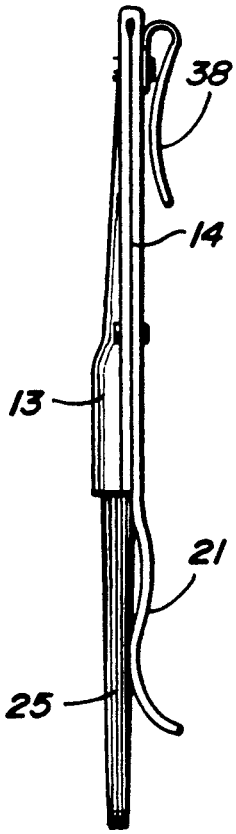
FIG. 10 is an edgewise elevation of the knife-and-sheath combination shown in FIG. 9 illustrating in particular the spring clip from the side.
Figure 11:
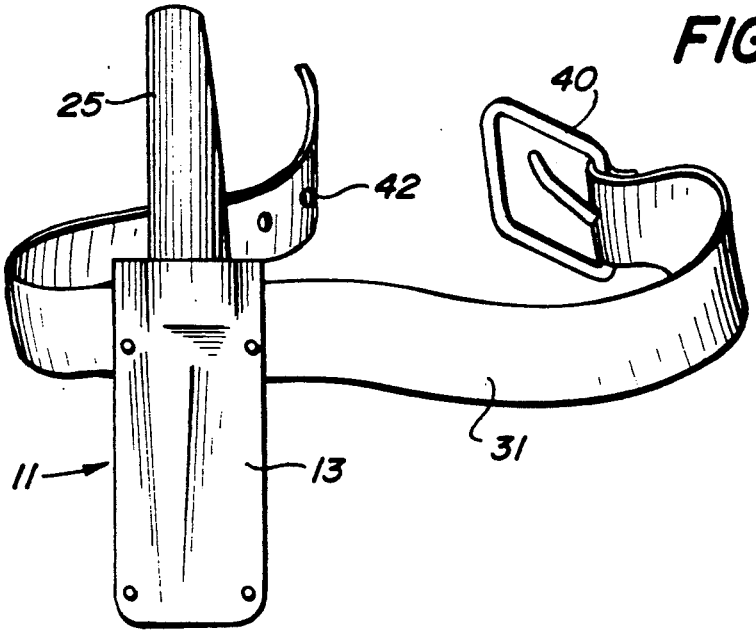
FIG. 11 is a diagrammatic illustration of a knife-and-sheath combination such as shown in FIGS. 9 and 10 with the clip attached to a belt.

FIG. 9 shows an alternative sheath form in accordance with the invention in which the sheath, instead of being provided with a large rectangular pocket piece such as shown in FIGS. 1, 3, 4, 5, 7 and 8 and in which the large pocket piece, or pocket retention clip, acts to stabilize the sheath by essentially filling the transverse space within the pocket, preventing the sheath from moving around in an uncomfortable fashion and also providing a more stable carrying arrangement with more weight bearing surfaces, the sheath 11 of FIGS. 9 and 10 instead is merely provided with a conventional clip or loop 38 on the rear. Such clip or loop 38 may be used to either clip to a surface such as a pocket as shown, for example, in FIGS. 7 and 8, but with considerably less stability and security and much more stress upon the pocket than with the use of the pocket retention clip shown in such figures, or may be preferably used to clip around a belt such as shown in FIG. 11.

It will be understood that in the arrangement shown in FIGS. 9 and 10, the sheath is designed to depend downwardly from a surface to which the clip 38 is attached. However, in FIG. 11 the same clip or loop 38 is attached at the top of the sheath and may be clipped to a belt 31 which passes through such clip or loop. A buckle 40 may then be interacted with orifices 42 in the end of the belt to bring the two ends of the belt together and place them about the waist of the wearer of the knife sheath with the sheath oriented upwardly as shown in FIG. 11. Rather than having a clip on the sheath, there may be provided an actual belt loop which may provide additional security. As indicated above, it will be understood in FIG. 11 that the clip or loop on the back of the sheath 13 will be positioned at the top of the sheath adjacent to the hilt or handle of the knife rather than at the bottom away from the hilt or handle as shown in FIGS. 9 and 10. Otherwise the knife would tend to be worn in an inverted position as shown in FIGS. 9, 10, 6, 7, and 8.

The close contact between the inside of the molded sheath 11 and the face of the knife prevents the knife from accidentally being knocked or jiggled from the sheath even with rather extreme athletic contortions of the wearer.

Consequently, it will be seen that the heat-molded sheath of the invention is useful not only for inverted sheath-type quick-draw knife arrangements, but also for more standard upright sheath arrangements in which it is desirable to prevent the knife from leaving the sheath due to minor accelerations and decelerations due to up-and-down movements of the body such as occur during, for example, jogging, running, climbing, leaping, and other outdoor and indoor athletic activities or other exertions. Furthermore, when the knife is held in an upright position rather than an inverted position, it will be found that a relatively larger heavier knife with a relatively smaller surface area closely contacted with the molded sheath will be effectively locked in the sheath. Thus, while the main usefulness of the invention is for an inverted knife sheath which allows quick draw of a knife held upon a forward portion of the human torso, and also allows convenient carrying of the knife suspended from a pocket, the invention also has substantial utility in a conventional knife sheath which may be supported upright on the body either from a strap around the shoulder, a waist belt, or other arrangement.

There is actually a critical range of knife weight and size to sheath size which will enable a combination of knife and sheath to be produced which will effectively hold an inverted knife. The inventor has found, for example, that a very effective size and weight for a knife inserted in the sheath of the invention is about 6 to 8 inches in length with a blade of about 2½ to 4 inches in length and about an inch in width which blade tapers gradually to a point at one end. A knife having such dimensions may be combined very effectively with a molded plastic sheath as shown and described in connection with the various figures and provides a very secure, but easily broken, contact between the sheath and the knife.

One very effective and attractive knife for combination with the sheath of the invention is shown in FIG. 2 previously discussed. It will be seen in FIG. 2 that the knife comprises a blade 27 having a handle 25 preferably as shown formed as an extension of the blade 27. In other words, the handle of the knife is, in effect, an extension of the blade having essentially the same blade thickness except along the sharpened edges and being essentially flattened like the original flat metal sheet material from which the knife is originally formed. The knife shown in FIG. 2 has an overall length of 7 inches and a blade section of 3 inches in length and about 1 inch in width at least at the root of the blade. This knife preferably has a weight of about three ounces, more or less equally distributed between the blade, the bolster in the center and the remainder of the handle, the outer portion of which may comprise a synthetic composition, although the weight may vary between about two to four ounces. If the weight of the knife becomes too large, i.e. of more than about five ounces or so for a knife of similar dimensions, the sheer weight of the knife is likely, if such knife-and-sheath combination are held in an inverted position and exposed to severe inertially-induced forces, to cause the knife due to small, inertially-induced movements over a period to slowly work its way from within the sheath. This phenomena of the knife creeping from the sheath is caused by sudden upward accelerations or downward decelerations of the movement of the knife and sheath or by sudden complete cessation of previous downward movement. A number of such accelerations and sharp decelerations can cause creep of the knife with respect to the sheath ultimately ending in sudden separation of the knife and the sheath when surface contact between the knife and the sheath becomes insufficient to prevent substantial slippage of the two surfaces past each other. However, if the knife is essentially light enough in weight when considered in relation to its surface area, it will be found that with the arrangement and material of the invention, the knife is very securely held and will not jiggle or be removed from the sheath by mechanically-induced shocks, bumps or other inertially-induced forces.

The plastic material used in the sheath of the invention should be one having a high rigidity and hardness combined with toughness and resilience. Such material should also be thermoformable, preferably by a conventional thermoforming process. One suitable material is an acrylic PVC or acrylic polyvinyl alloy-type thermoplastic sheet material sold by the Kleerdex Company presently of Aiken, S.C., which company sells their material under the registered trademark "Kydex®". Kydex® 100 thermoplastic sheet has a modulus of elasticity in flection of 330,000 pounds per square inch at room temperature. Kydex®100 thermoplastic sheet has a high degree of toughness and resilience as demonstrated by a tensile elongation in excess of 100 percent and an impact strength of ten to fifteen feet per pound per inch (10–15 ft./lb./in.) of notch in the so-called Izod Notched Test. The material has a very low water absorption and relatively low coefficient of thermoexpansion which endows Kydex® parts with a very high degree of dimensional stability. In spite of its high modulus of elasticity at room temperature, the material is easily formable at elevated temperatures above about 175°. The heat deflection of Kydex® at 177° Fahrenheit, for example, is about 66 psi stress.

A suitable Kydex® thermoplastic sheet for forming knife sheaths in accordance with the invention will have a thickness of about 1/16th to ⅛ of an inch more or less. A sheet 3/32nds of an inch in thickness has been found very satisfactory. For larger and heavier knives, however, a sheet one eighth inch in thickness or even more may be desirable. Briefly, the sheet material would be sheered or otherwise cut into two attached panels having the dimensions of the two sides of a desired knife sheath, the sides usually being essentially mirror images of each other, except that the rear panel of the sheath, i.e. the side or panel designed to be worn next to or closest to the body of a person, will preferably, but not necessarily, be provided at one end with an extension which is ultimately formed into a biasing member bearing against the side of the hilt of the knife to aid in retaining such knife by frictional contact against undesired withdrawal from the sheath. It is preferable for the connection between the two halves or panels of the sheath to be continuous at one end, which will also preferably be located adjacent the outer end of the knife blade in a completed knife sheath. The two halves of the sheath are then folded together with sufficient application of heat to allow easy bending or folding and are partially secured together usually by two rivets or the like. The two sheath panels are then heated to the thermoforming temperature of the material of which they are constructed and may be further secured together or left for the time being only partially secured as explained below. A knife of the exact dimensions of the knife that is ultimately to be sheathed or carried in the finished sheath, and preferably the same knife, is then inserted between the two panels of the sheath and the two panels are preferably secured at least partly together by any suitable fastening or securing means such a rivets or the like which will form a rigid interconnection between the two panels.

Alternatively, the two panels forming the sheath can be attached together completely or solely by suitable fastenings such as rivets, screw fastenings and the like prior to the insertion of the knife between the two panels. It is also possible to weld the two panels forming the sheath together at the edges, if the edges are heated sufficiently such as, for an example, when using a Kydex ® thermoplastic sheet to about 620° for about three to ten seconds. It is also possible to drill or otherwise form orifices or holes in the two panels near the edges and to weave a linear binding means through the orifices to bind the two panels securely together. It has been found that a riveting of the two panels together at two or three more or less evenly spaced points along each side is one of the most satisfactory methods of attaining a rigid securing of the two-piece sections or panels together. The use of rigid metal fastenings having expanded heads on each end such as rivets, or in the case of screw heads, with expanded stems on the opposite side, will be found to be generally more secure than, for example, attempting to attain a good weld of the materials together. However, any means which will effectively permanently bind the two edges of the sheath panels together will be found to be satisfactory. As explained below, it may frequently be convenient to secure the panels of the sheath together with eyelets rather than rivets in order to later take advantage of the permanent openings provided in the center of the eyelets.

After the edges are bound together or partially bound together and the panels heated to the thermoforming range, which for Kydex ® thermoplastic sheet is 380° to 390° F., the knife which is to be used within the sheath or, alternatively, another knife or knife blank having the same dimensions as the knife which is to be housed in the sheath, can be inserted into the fabricated sheath. The combined sheath-and-knife combination thereafter is placed in an effective thermoforming press arrangement with the temperature maintained, in the case of a Kydex ® thermoplastic sheet material, within a range of about 380° to 390° F., and an external pressure is applied to the sheath from both sides through a flexible padding. Such flexible padding, which is preferably positioned directly on the surface of the press, effectively transfers the pressure of the press equally to all portions of the sides of the sheath, very intimately molding the sides of the sheath about the knife within the sheath forming a receptacle opening having the exact dimensions of the knife. A pressure of 30 to 45 or more psi during the thermoforming is usually sufficient to attain the intimate molding of the sheath to the knife which is desired. The entire assembly of the knife and the surrounding sheath is then allowed to cool to room temperature, at which point the knife can be removed, and when replaced, will be found to be gripped tightly by the sides of the sheath. If one side of the sheath has an extension or guard attached to the top, such extension or guard can then be thermoformed in a suitable curved press which will place a permanent curvature in such guard to form a resilient biasing or friction member which will press against the hilt or handle of the knife. As explained above, such curvature aids in retaining the knife within the constricted opening within the sheath. The biasing member or guard, however, need not have the biasing curvature applied to it, since it will be found that if the sides of the sheath itself are sufficiently closely molded to the knife, as well as to an inversely slanted bolster the knife will be very securely held within the sheath, even when the sheath is inverted. Alternatively the extension or spring member may be used without the inversely curved bolster.

The padded or resilient surface of the thermoforming press also aids in preventing the heat of the already heated thermoformable plastic from being withdrawn from such plastic before it has a chance to be thermoformed.

The heating of the thermoplastic is preferably not conducted in the thermoforming press itself because the high thermoforming temperature of 380° to 390° F. in the case of Kydex ® 100 thermoplastic sheet material is sufficiently high to degenerate the epoxy adhesive in the handle material or coating of a knife and also to possibly draw the temper of a knife which can occur at temperatures over 300° F. and it is desirable, as noted above, for the same knife as is to be used in the sheath to be used for thermoforming the sheath. Most knives of this nature are custom or specially made to order or made by hand. However, if machine manufacture is used where the exact dimensions of the knife blade, in particular, and the bolster to a loss critical extent, can be mass produced by machine means to exact tolerances, a knife blank having the exact blade dimensions but no necessity to maintain temper and having a solid metal handle, or even no handle, can be used to insert into the sheath and the entire assembly heated directly in the thermoforming press. After the panel sheath material is effectively thermoformed, it is removed from the press and allowed to cool.

As a last step, the sheath can be supplied with a supporting means either in the form of a substantially rectangular pocket insertion member or in the form of a loop on the back or a clip on the back. If the knife is to be carried in an inverted position, such clip or loop or other holding or supporting means will be attached by any suitable means to the bottom of the sheath near the point of the knife and if the knife is to be carried in an upright position, such as, for example, on the belt of the wearer or the like, the holding or supporting means will be fastened near the top of the sheath next to the handle of the knife.

In a preferred arrangement, as explained above, a rectangular piece of a semirigid material, which is preferably the same material of which the sheath itself is made, can be attached to the bottom of the sheath more or less along one edge of the rectangular material to form a pocket retention clip. Such attachment can be readily made by a screw-and-post arrangement through openings passing completely through the bottom of the sheath and one end of the rectangular pocket retention clip. One preferable embodiment of the invention is thereby formed which may be carried in the pocket of a shirt or coat as shown in FIGS. 7 or 8 for example.

An illustration of the sequence of steps in fabricating a knife-and-sheath combination in accordance with the invention as described above is shown in FIG. 12 wherein beginning on the left, in a series of steps or stages, which may be referred to as steps A, B, C, etc., not specifically identified in the drawings, there is provided as the first step, or step A, first a knife 23, which has been initially fabricated at some other point in a manner as generally summarized above and also well known to those skilled in the art of knife making, plus an oblong panel 39, of the rigid-resilient plastic composition of which the sheath of the knife is to be formed, for example, Kydex® thermoplastic sheet. Such panel 39 is next folded across its central section into a folded-over two panel blank 40 in what may be referred to as stage B. This blank 40 is then heated to thermoforming temperature in a furnace 42 which may be any suitable furnace such as, for example, a muffle furnace or the like in what can be referred to as stage C. After removal of the blank 40 from the furnace or other suitable heating means the knife 23 is inserted into or between the two panels which have been preliminarily formed into a loose sheath 13A.

The two panels of the blank 40 which have been folded and secured together and heated to form the initial loose sheath blank 13A as stage B, can be secured together by suitable fastenings such as the rivets 17 either initially before the knife 23 is inserted between the two panels after heating such panels or can be secured together after the knife blade has been inserted between the two panels. Preferably, as indicated above, the two sections or panels are initially secured together by only two rivets. The sheath-and-knife combination is next placed in a thermoforming press 41 i.e. with the knife inserted between the two flat panels of the sheath blank 13A in stage E and compressed between an upper press half 43 and a lower press half 45, each of which have upon its face, a soft or resilient cushioning 49 forming a resilient press face which, when the press faces are compressed against each other as shown in a stage F, place an equal pressure upon all portions of the surface of the heated plastic material as well as the uncovered portions of the knife not within the sheath blank 13A which may come between the press faces, effectively placing a uniform pressure across the surface of the sheath and intimately molding the inside of the sheath panels against the surface of the knife blade and any portion of the knife handle which has also been inserted within the sheath. As shown particularly, for example in FIG. 3, a so-called bolster portion 63 of the handle 25 of the knife may be inserted into the top of the sheath and the panels of the blank 13A molded intimately against the surface of the bolster which preferably has a general slight increase in dimensions in the direction of the blade at least on one side of the bolster. This has some advantages in gripping the knife and is a preferred arrangement for gripping the knife in combination with gripping the blade, although it has been found not to be necessary if the handle is frictionally gripped by a spring biased member from the side.

The press 41 is next opened again using handle 51 to the position shown as stage E before it was closed, and the now-molded knife and sheath combination is removed as stage G. This knife and sheath combination can then in step H, be combined with a rectangular pocket retention clip 15 by means of the screw fastenings 19 which attach the pocket retention clip or retainer to the sheath near the bottom of the sheath to form a finished sheath in stage H as shown which is essentially identical to the arrangement shown in FIGS. 3 and 5, except that in the sheath arrangement shown formed in stage H of FIG. 12, the sheath is not provided with an extension on one end of the rear panel of the sheath molded so that it is biased continuously against the hilt of the knife. Such a biasing extension is not provided for in the embodiment of the combined knife and sheath of the invention shown being fabricated in FIG. 12. If such biasing means was used, there would normally be an intermediate hot molding or thermoforming of the biasing means by a separate mold subsequent to the molding of the sheath panels against the knife surface. Alternatively, a molding arrangement in the press 41 can be provided, particularly if press 41 is a hot press, in which the biasing means can be formed into an S shape and biased against where the knife hilt would normally be, using a knife blank as explained above during the molding of the sheath blank panels to the knife blade blank. Such molding, however, is more usually done as a separate operation and can actually be accomplished by manually molding a heated extension of the panel, since it is preferable to bias mold the biasing guard or panel beyond the point that it would normally be when positioned against the hilt of the knife and attaining this arrangement is difficult when the knife is inserted into the panels of the sheath when working with custom-made knives.

Figure 12:
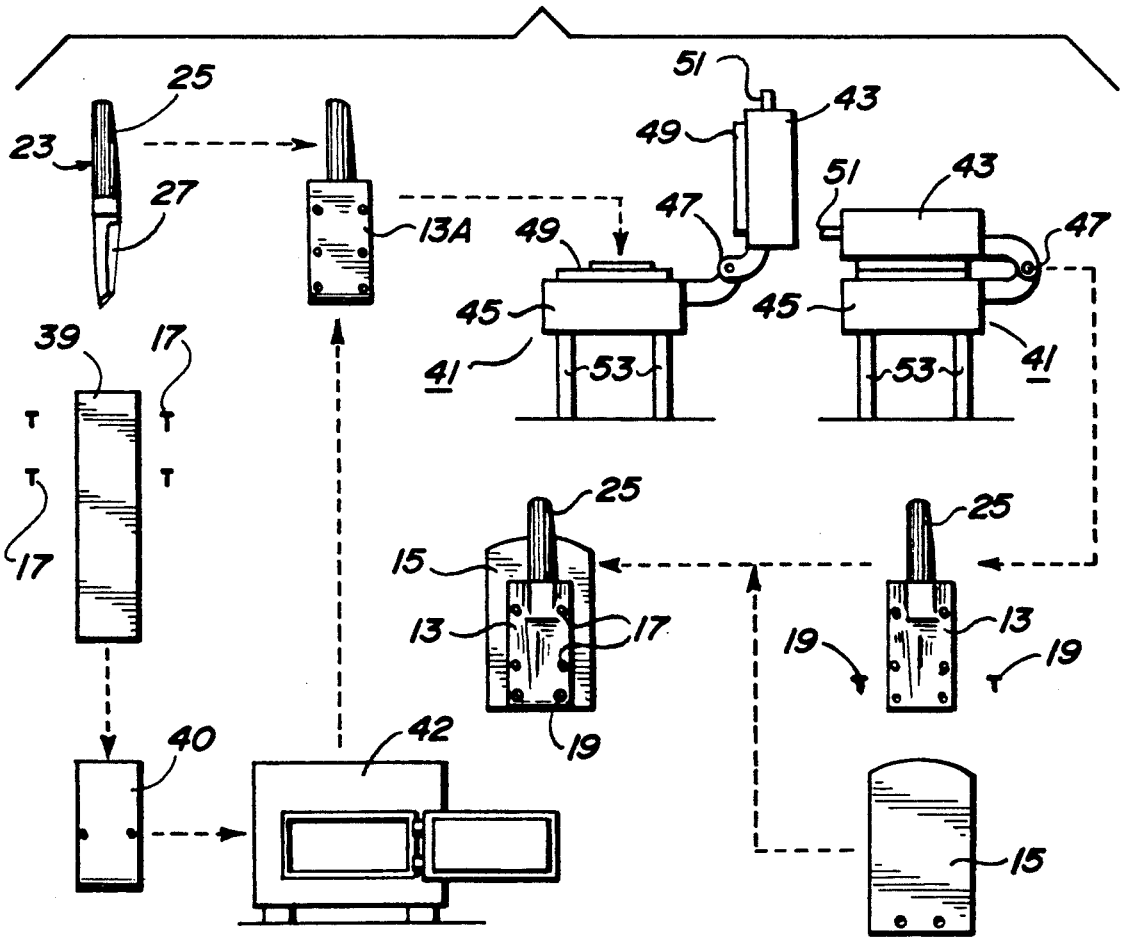
FIG. 12 is a diagrammatic flow sketch of the fabrication of a sheath in accordance with the present invention.

The procedure shown in FIG. 12 can be varied, not only by alternatively securing the sheath edges together before inserting the knife blade between the panels or by inserting the knife blade between the panels before the edges of the panels are secured, but also with respect to other aspects of the formation of the sheath of the invention. For example, instead of the preferred folding of the two panels of the knife sheath together from the bottom, such panels could be folded together from the side. However, it has been found that folding the panels together from the bottom provides a more secure gripping of the knife blade at the end of the knife where a considerable amount of the clamping force which retains the knife within the sheath is attained. If such sheath panels are not folded together from the bottom, then a very secure fastening of the sheath panels together from the bottom must be effected and it is also desirable that the biasing extension from one side of the sheath, which extension is molded, as explained for permanent biasing against the side of the sheath, should also be used, particularly if the sheath-and-knife combination is to be used in an inverted carrying position.

It will also be recognized that particularly if the two panels are not to be folded together from the bottom, they need not be folded together at all, but can be made in two separate pieces which are then securely fastened together, very desirably before a knife is inserted between them. Since it is desirable for the sheath material to be completely heated prior to inserting the knife and placing in the press, and the press itself need not or even should not be heated, there should be sufficient insulation in the padded faces of the press to prevent the heat from being very quickly extracted from the knife-and-sheath combination. The sheath panels should stay warm sufficiently long for a complete molding of their inner surfaces to the face of the knife to be attained. During heating of the press to about 380° to 390°, or preheating of a combination of sheath and special knife blank to such range, care should be taken not to heat the plastic to its decomposition range. For example, in the use of Kydex ® thermoplastic sheet, the plastic should not be heated above about 400° F. or else chlorine will be released from the polyvinyl chloride which is not only environmentally undesirable, but initiates the beginning stages of decomposition of the plastic material. Kydex ® thermoplastic sheet is formed of an alloy between polyvinyl chloride and acrylic plastic material rather than a specific chemical composition so that the effective heat upon the two distinct phases of the plastic may have varying effects.

Summarizing the above, a preferred method of forming the knife-sheath combination of the invention is as follows with the stages labeled A, B, C, etc.:

A. An already fabricated, or prefabricated, knife plus an oblong panel of a rigid-resilient thermoformable thermoplastic having a size and configuration suitable for forming the two side panels of a knife-sheath is provided.

B. The oblong panel of thermoplastic is exposed to heat in the center and folded in half forming a blank comprising the two side panels of the sheath to be formed and such side panels are preferably partially secured together to form a sheath blank.

C. The folded-over sheath blank is heated to thermoforming temperature.

D. The knife, or possibly a blank of the knife, is inserted between the heated panels of the sheath blank.

E. The heated blank panels and inserted knife are placed in a padded surface thermoforming press.

F. The press is closed to compress the heated sheath panels intimately against the surfaces of the knife inserted between them.

G. The press is opened after intimate molding of the sheath material to the knife and the sheath and knife removed.

H. The sheath panels are, if necessary, completely secured and a generally rectangular pocket retention clip is secured to the end of the sheath farthest from the knife.

The firm grip which the thermoformed plastic sheet attains with the knife within it is dependent upon intimate thermoforming of the two together so that the panels of the sheath after cooling continue to exert a steady force against the knife blade. Consequently, it is necessary that as preferred, the same knife be used during thermoforming as will be used in the sheath, or at the least, that a knife or knife blank having the exact dimensions of the knife which is to be carried in the sheath be used as a blank during the thermoforming. Since the knife is intended, however, to be releasable with a firm, manual withdrawing grip, it is obviously not desirable that the knife be interlocked too securely with the plastic sheath. Consequently, whether the knife is interlocked securely enough with the sheath to allow the knife to be carried in an inverted position without dropping from the sheath depends somewhat upon the weight of the knife, since the gravitational pull and the inertial effects of sudden movements will be greater with respect to a more massive or heavy knife than with respect to a fairly light knife. Consequently, in a preferred version of the arrangement of a knife, for example, as set forth above, having an overall length of about 7 inches with the blade being about 3 inches, the knife may desirably be of a weight of about 3 ounces, more or less, or, in other words, be a fairly light knife which does not have too much gravitational interaction with the earth or inertial effects due to sudden movements of the sheath-and-knife combination which might tend to slowly or even quickly work the knife out of its sheath. Different size knives, therefore, should, to some extent, have varying arrangements for gripping the plastic against the sides of the blade of the knife.

One way of attaining an increased grip of the thermoplastic against the sides of the blade of the knife is to thermoform the panels of the sheath about a knife blank having somewhat smaller dimensions, particularly with respect to thickness, than the actual knife which is to be inserted and carried within the sheath. This will provide a tighter gripping with the blade of the knife which will withstand greater gravitational and inertial effects upon the knife which might otherwise tend to work the knife out of its sheath. Normally, however, it will be undesirable to use a smaller knife blank than the size of the actual knife to be carried, because the grip of the plastic against the sides of the knife becomes so great it will be substantially impossible to withdraw the knife from the sheath with a reasonable manual force or tension. For example, the knife can be locked within the semirigid thermoplastic materials so tightly that when it is attempted to withdraw the knife from the sheath, such sheath, particularly if connected to a pocket in or upon clothing of the wearer, for example, may pull the sheath out of the pocket or even tear the pocket rather than withdrawing the knife from the sheath. For this reason, therefore, it has been found highly desirable to mold the sheath panels about a knife blade having the exact dimensions of the knife which is to be carried in the sheath and preferably, because knife dimensions may vary somewhat, even in mass-produced knives, it is most preferable to mold the sheath panels to the exact or precise knife which is normally to be carried within the sheath.

From the above, it will be recognized that the present invention provides a very desirable arrangement for providing a knife-and-sheath combination from which the knife can easily be withdrawn by the wearer, but from which the knife will not ordinarily be displaced by accident, either by gravity or by other similar forces such as inertial forces or by accidental impacts and the like. In particular, the invention provides a very convenient, effective and economical arrangement by which a knife may be carried in an inverted position for quick withdrawal from its sheath from a position near the front of the body. The combination knife and sheath is both attractive in appearance, inconspicuous in use and economical to make.

It will also be understood that it would not necessarily be required to start the construction of the knife sheath with two separate or even attached panels or walls. Instead, the sheath could, for example, be extruded in a single piece from rigid-resilient thermoplastic of the necessary properties and then after the insertion of a knife into a reasonably constricted central orifice applying heat and pressure to the outside to mold the plastic to the knife.

While the knife sheath, per se, and the sheath-and-knife combination of the invention have been described and shown in the drawings as set forth above in connection with the force of a thermoformed thermoplastic sheath molded against a knife blade for resilient gripping of the same size or a larger knife blade, either without, or in combination with, resilient pressure against a portion of the knife handle, either by the sheath itself or by a resiliently biased extension protruding from one panel of the sheath or by both of such expedients, i.e. by directly gripping the knife blade plus resilient contact with the handle, it has been discovered that a further, very effective interlocking of the knife upon the handle using the thermoformed sheath material in accordance with the invention can be attained by providing a section upon the lower portion of the handle of the knife, which increases in lateral dimension toward the lower end of the knife. When the rigid-resilient thermoplastic material used as sheath material in accordance with the invention, which, as explained, may be Kydex® thermoplastic sheet material or other thermoformable plastic material having comparable physical properties, is molded about this section of inversely changing dimensions, the rigid yet resilient nature of the plastic effectively locks such increasing dimension section of the handle behind such molded plastic, unless and until sufficient force is applied to actively deform the resilient plastic material to expand the sheath structure to allow the oversized section of the handle to pass. A very secure interlocking can thus be provided that can furthermore be varied as desired by varying the dimensions of the oversized handle portion which must pass between the plastic panels or the dimensions of the flexible thermoplastic that must be displaced. The pertinent dimensions of the plastic displaced are both the thickness of the plastic and the area dimensions of the plastic which must be flexed to allow the enlarged handle portion to pass. For example, the three thirty seconds (3/32nds) thickness of material suitable for small knives as set forth above may be displaced or deflected more easily than, for example, one eighth (⅛th) inch thick material which may be desirable to use to securely interlock with larger and heavier knives. Likewise, a greater area of plastic material of the same thickness will be less easily displaced than a smaller area so that larger areas of displaceable material may be used with heavier knives than with smaller knives.

Figure 14:
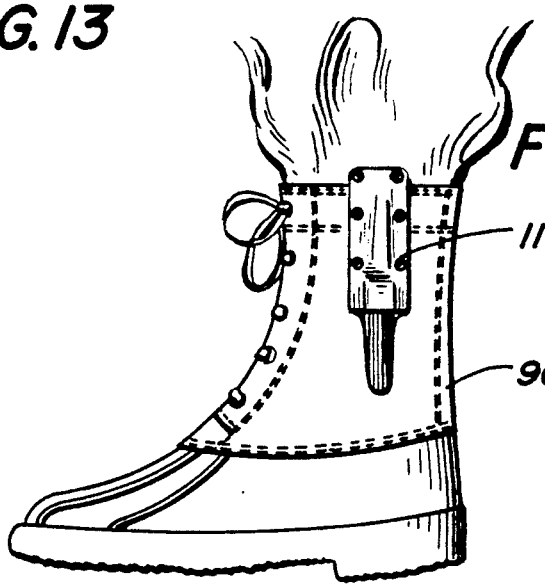
FIG. 14 is a diagrammatic view of the sheath shown in FIG. 13 inserted into a boot.
Figure 13A:
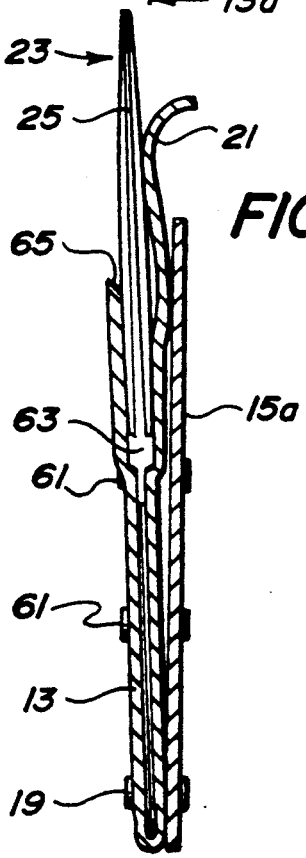
FIG. 13*a* is a sectional view along line 13*a* of FIG. 13*a* of FIG. 13 illustrating how the sheath grips the knife blade and in particular the inversely increasing contour of the bolster.

A further illustration of a knife-and-sheath combination making use of the increasing dimension principle of the invention is shown or illustrated in FIGS. 13 and 13*a* in which FIG. 13 is a side elevation of the type of knife-and-sheath arrangement shown in FIGS. 1 through 5. FIG. 13 has an external appearance essentially similar to that of FIG. 3 except that eyelets 61 rather than rivets 17 are used to secure two panels, i.e. the front and back panels 13 and 14 of the sheath to each other. The particular efficiency or usefulness of the eyelets will be discussed presently. FIG. 13 also shows a different form of retention clip secured to the back by the screw fastenings 19 which, it will be understood, may be screw-and-post type fastenings. The retention clip 15*a* is narrower than the preferred pocket-retention-type clip shown in previous figures, for example, FIGS. 1, 2, 7 and 8, and although the retention clip 15*a* can be used in a pocket also does not have all of the advantages particularly as to stability and balance of the retention clip 15. Instead, however, the narrow clip 15*a* is particularly adaptable to insertion into a boot as shown in FIG. 14 or placing in the belt or the like or for any other use where a flat retention clip is desirable, but the width of the retention clip 15 would not be. Some specialized work shirts, for example, have the breast pocket divided to accommodate pencils and the like in one-half or one-quarter of the pocket and the wide retention clip 15 would not be suitable in such pockets.

FIG. 13*a* is a further cross-section of the sheath illustrated in FIG. 13 shown from the edge of the sheath sectioned along section line 13*a* and shows how the thermoformed plastic of the sheath is intimately molded to the knife blade and the bolster of the handle which exhibits a downwardly increasing dimensional increase. Such dimensional increase of the bolster is exaggerated from what it would preferably be, since one of the great advantages of the use of this arrangement for securing the knife in the sheath is that the size differential required when using the sheath material specified for the invention is so slight as to be virtually undetectable without very close visual inspection or even the use of actual measuring instruments such as, for example, machine measuring calipers or the like.

In FIG. 13 it can be clearly seen how the knife 23, and particularly the bolster section 63 is accommodated in the final molded sheath 13. It can also be seen that the side panels 13 and 14, and particularly panel 13, are heat molded or expanded outwardly to, in effect, closely grasp the sides of the knife and particularly to closely encompass the bolster section. As noted above, the dimensional change from one end to the other of the bolster 63 is highly exaggerated in FIGS. 2*a* and 13*a* for clarity, as it actually has been found to be quite effective if the differential in size from end to end of the bolster or from the beginning of such dimension change to its conclusion whenever initiated and ending is only about one thirty-second (1/32nd) of an inch and a good range of differential might be from one sixty-fourth (1/64th) of an inch to three sixty-fourths (3/64ths) of an inch or less preferably from about one one-hundredth (1/100th) of an inch to one sixteenths (1/16ths) of an inch. It is neither desirable to have too small a differential from end to end of the bolster, particularly if the bolster is to be relied upon completely to hold the knife in the sheath, nor too great a differential which will make the knife too difficult to disengage from the sheath. As will be realized, the differential on the bolster can be relied upon completely to lock the knife in the sheath so that molding over the remainder of the knife blade is not even strictly necessary. However, it will be found that it is preferable to use molding completely over the knife blade to stabilize the blade at least in an edgewise direction. Otherwise, the knife may tend to rock in the sheath leading to loosening of the grip of the resilient plastic with the bolster. It is necessary if one does not wish the lower end of the bolster to be seriously impeded in being seated in the sheath to chamfer the top of the outer panel of the sheath as shown at 65 to facilitate passage of the knife into the sheath. Alternatively, the lower portion of the bolster can be beveled or slanted to facilitate insertion of the knife home in the sheath.

FIG. 14, as indicated above, shows the embodiment of the invention shown in FIGS. 13 and 13*a* clipped onto a boot by insertion of the retention clip 15*a* into the top of a boot 96, and it will be understood that the pounding and jarring that a boot retention arrangement provides to the knife is a critical test of maintaining the knife in the sheath. In this embodiment, therefore, it is desirable to include both full blade contact, inverse differential dimensioning of the bolster and having a spring contact against the handle as shown, although in most instances only one of these, or even the use of the differential dimension bolster only, is all that is necessary.

Figure 15:
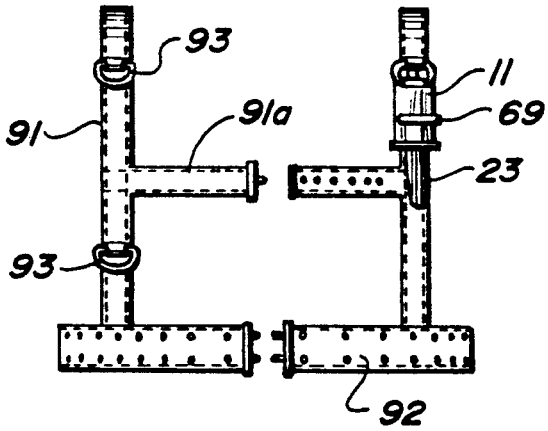
FIG. 15 is a front view of a military-type belt or harness including supporting arm loops upon which a knife-and-sheath combination in accordance with the invention is attached.

FIG. 15 is a front elevation of a military-type belt and harness 91 which normally has a plurality of loops such as D-rings 93 and the like means for supporting equipment carried upon such belt. As will be seen in FIG. 15, a combat knife and sheath may be attached to such harness in any suitable manner in an inverted position as shown. The sheath 11 may, for such attachment, be provided with suitable clips at both ends for attachment and may also and, in fact, will usually, be a sheath such as shown in the other figures or particularly as shown in FIGS. 9 and 10. When a fairly heavy knife such as a military knife is used in real or simulated combat situations, it is usually desirable to use several methods of securing the knife in the sheath including direct resilient contact with the sides of the blade of such knife. Furthermore, since the sheath will be usually very securely attached to an actual harness by several attachments upon which a considerable amount of force may be placed without damage or disturbance of the attachments on the harness, it is acceptable to require considerable force to be applied to the knife in order to draw it from the sheath. Fairly stiff sections of plastic sheath material may, therefore, be used. Also, the sheath may preferably be molded over a knife blank having a blade of slightly smaller transverse dimensions than the final knife which is to be accommodated, which will in any event usually be machine made and, therefore, closely dimensioned.

Figure 16:
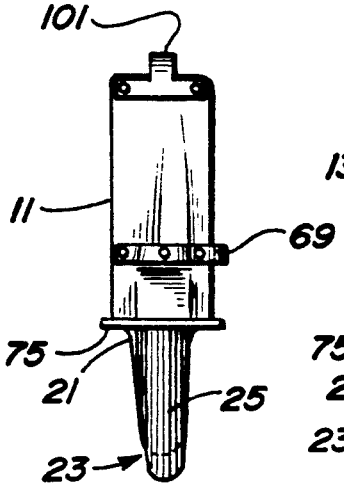
FIG. 16 is a front view of a further sheath-and-knife combination showing in larger scale the military style knife shown hooked to the military-type harness shown in FIG. 15.
Figure 17:
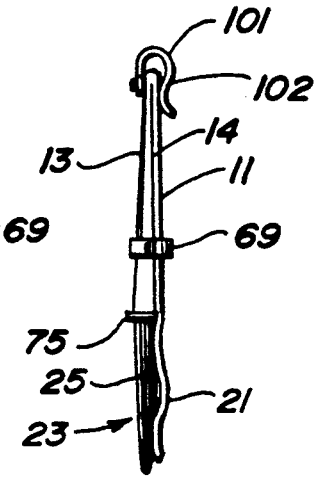
FIG. 17 is an edge view of the knife-and-sheath combination shown in FIG. 16 showing the hook and clip arrangement for attaching to the shoulder straps of the harness shown in FIG. 15.

FIG. 16 is a front side view and FIG. 17 is an edge view of a knife-and-sheath combination in accordance with the invention wherein the knife is a military-type knife which may be clipped onto a military-type equipment belt such as shown in FIG. 15. In FIGS. 16 and 17, a bowie or military-type knife 23 is inserted into a sheath 11 which has attached to its front panel 13, a clip formed of the same material as the rigid-resilient material of the sheath or other suitable material. The clip is formed in the shape of a "T" in which the cross section is secured to the front of the sheath by any suitable fastening such as screw fastenings and the intersecting section of the T is bent into a hook or clip shape 101 which fits around a "D" ring or other ring 93 upon the harness shown in FIG. 15 or other equipment carrier. The knife blade, which is not shown, will be understood to have a complete interengagement of the blade with the sheath material which will, combined with a frictional engagement with the handle by the spring member 21, securely hold the knife in the sheath until sufficient outward, or more particularly downward, force is applied to the knife handle to remove said knife from the sheath.

It will be seen in FIG. 17 that the clip 101 may closely confine one of the D-rings 93 of FIG. 15 in its end and may be easily clipped over such D-ring by holding the D-ring out away from the harness 91 and moving the sheath downwardly with respect to such ring. The sheath 11 also has mounted upon its front side and extending around one side to the back a narrow U-shaped clip fitting 69 which provides sufficient room between the back of the sheath and the inside of the back leg of the U, which is not attached to the rear of the sheath, to allow one of the harness belts 91 to slip into the intervening space. When, therefore, the clip 101 has been attached to one of the upper D-rings 93 on the harness belts 91, the knife and sheath can be biased or inclined to the side and the clip 69 fitted over the belt after which the sheath is again rotated to vertical, the clip 69 now serving to prevent the knife from flopping around upon its suspension point on the D-ring. The knife illustrated in use in FIGS. 16 and 17, as well as 15, includes a guard 75 which prevents the bolster, if any, of the knife from entering the sheath so the preferred inward dimensional change of the bolster cannot be used to aid in interengaging the sheath and the knife. However, particularly, if the sheath is initially molded over a knife blade having somewhat lesser blade dimensions, the knife will be found to be very securely held in the sheath and the strength of the military belt and attachments will be found to be quite adequate to allow a fairly heavy tension to be applied to the knife handle to remove the knife from the sheath without damage to any of the components.

Figure 18:
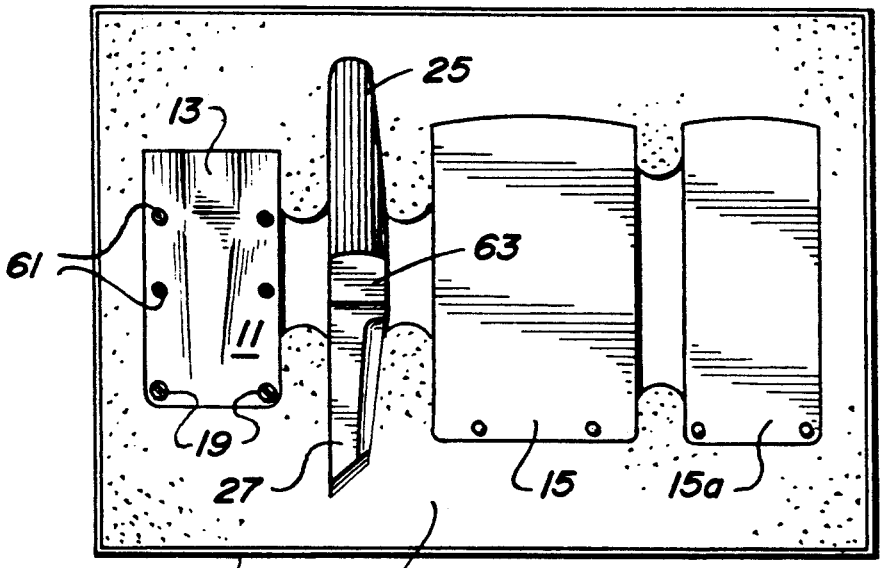
FIG. 18 is a plan view of a knife and sheath kit in the form of a package including within it a knife, a sheath and two different size back or pocket flaps for attachment to the sheath.

FIG. 18 is a top view of a kit including a knife, a sheath in accordance with the invention, and two alternative retention chips for use in various arrangements. The sheath 11 is one of the sheaths such as shown in FIGS. 1–5 or 13 or **13*a* including preferably a bolster retention arrangement, while the knife is like the knife shown in FIGS. 2 and 2*a*. The retention clips 15 and 15*a* are respectively a pocket retention clip such as shown in FIGS. 1 and 3, for example, and a narrower retention clip such as shown in FIG. 13 for use in boots and other narrower accommodations. The entire package has been given the reference numeral 35, the package as illustrated, for example, being essentially an overall box shown as the outside of the package with a plastic compartmented liner 37 contained within the box in the compartmentation of which are displayed the various components of the knife and sheath kit. The outer box could, of course, be eliminated, retaining only the plastic compartmentation and a top or covering such as a cardboard or the like top, not shown, or a clear plastic covering could be used. Other forms of packaging could obviously be used as well, and other components of the assembly such as loose screw fastenings, additional clips such as the clips shown in FIGS. 9 and 10 and 16 and 17** could also be included. Nor would the package in which the kit parts are contained have to be a compartmented or a display packaging.

Figure 19:
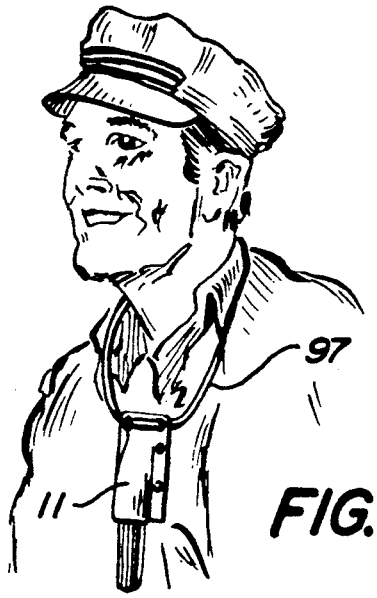
FIG. 19 is a perspective view showing the clip or pocket flap removed from the sheath with a thong passed through the screw openings in the end of the sheath and around the neck of a human figure allowing the knife and sheath to be supported upside down suspended from said thong.

FIG. 19 shows a knife sheath such as shown in FIGS. 1 or 13 where the two screw fastenings 19 have been removed and the pocket stabilizing piece or clip 15 has been removed after which a thong or line 97 can be threaded through the screw fastening openings and the line or thong thereafter worn around the neck, as shown in FIG. 19, with the knife and sheath suspended in an inverted orientation. The ability to remove the screw fastening and detach the pocket or other retention clip and then conveniently hang the knife around one's neck in an inverted, easy-to-reach position is thus one of the lesser, but still desirable, advantages of the preferred construction of the knife. Hanging the knife around one's neck is particularly convenient for divers and the like who may wish a knife to be readily releasable, but may not have convenient pockets or other accouterments to insert the knife within and who may be subject to unusual bodily orientations during wearing of the knife. Kydex ® thermoplastic material is quite resistant to the absorption of moisture and consequently is an ideal sheath material for use in underwater environments. Persons who use the knife frequently, such as wood whittlers and the like, or who do not normally wear clothes with suitable pockets for use of the retention clip such as some sailors, may wear the knife suspended from a neck thong.

Figure 20:
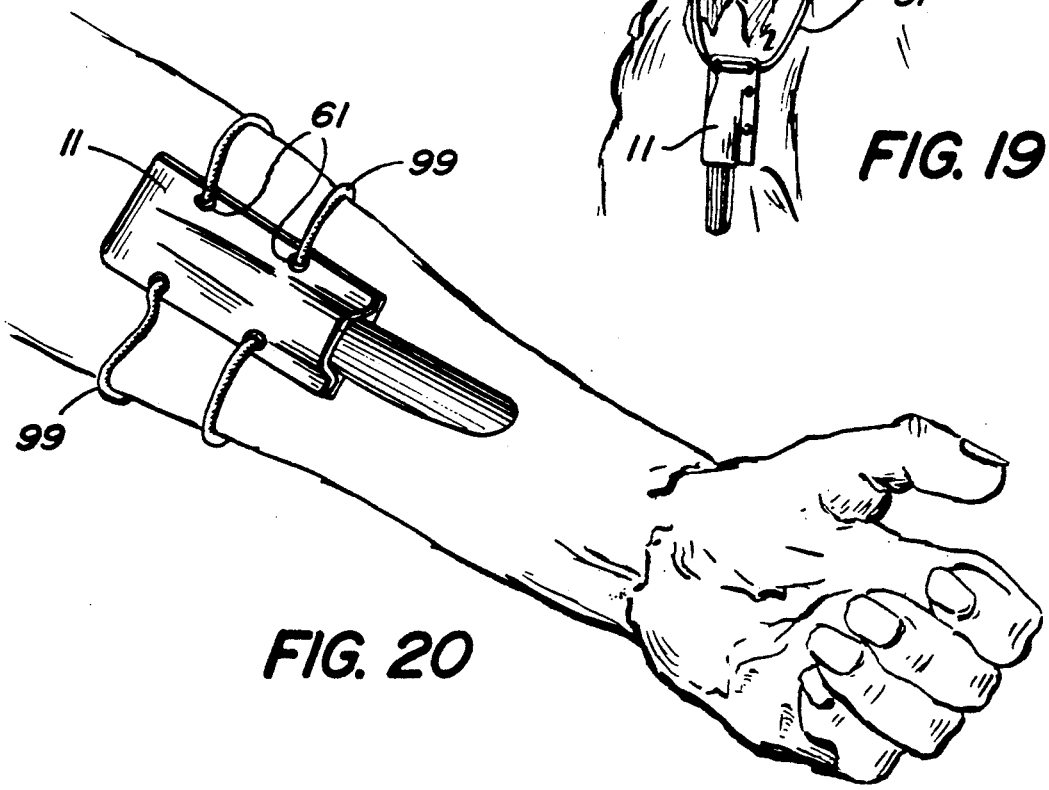
FIG. 20 is a perspective view showing a sheath in accordance with the invention provided along the edges with eyelets with a thong or tie string passed through the eyelets and secured to a limb, in this case, the forearm, of a human figure.

FIG. 20 shows another lesser convenience of the preferred construction of the knife as shown in FIG. 13 wherein eyelet-type fastening means are used rather than rivets to secure the two panels of the sheath together. If the retention piece or clip 15*a* is removed from the sheath 13 as in FIG. 19, short tie strings 99 may be secured through the eyelets 61 and used as shown in FIG. 20 to tie or secure the sheath and its included knife to an extremity of the body of a person such as an arm, as shown, or a leg. The knife, which remains securely retained in its sheath, may then be easily withdrawn when required. Police officers frequently wish to wear a hidden knife about their lower leg and the sheath-and-knife combination of the invention is thus ideal for such officers as well as for others having a need for tying a knife in a position for use upon various portions of the body. The inverted orientation of the knife allows it to be easily withdrawn without significantly pulling up a sleeve or pants leg.

It will be recognized from the above description and explanations that the present invention of an improved security sheath for s knife can take several and various forms and encompasses a sheath intimately thermoformed to the blade of a knife so as to retain the blade in the sheath by a substantial pressure-type grip alone or coupled with either a preferred inversely increasing transverse dimension of the lower portion of the handle of the knife, partially over the bolster of the knife, or alternatively with a biasing-type pressure against the back of the handle induced by a spring-biased friction member or, still more preferably, by both an inversely increasing transverse dimension of the lower handle and a spring-type side biasing pressure against the handle.

It will be further recognized that the invention also encompasses the use of a pocket-type retention clip upon or in connection with a knife sheath in which the clip is attached to the sheath in the lower portion of the sheath near the end of a knife blade allowing the knife to be suspended from a pocket or the like with an inverse orientation with the clip inserted within the pocket and preferably substantially bulk stabilizing the clip in such pocket, the knife being retained in the sheath preferably against gravitational and inertial forces by the other aspects of the present invention, but alternatively, if desired, also by other means such as by various known catches and detents.

In the foregoing description and specifications as well as the claims set forth hereinafter, the following terminology is to be understood to have the meanings indicated.

"Sheath" means a covering for the blade of a knife and in which such knife may be carried. Such sheath may be fabricated from separate panels secured together to form said sheath, but also may be formed from a single unitary piece of material encompassing at least the blade of a knife.

"Gravitationally-induced movement" means an acceleration, motion or movement due to gravitational attraction to the earth.

"Inertially-induced forces" means forces generated as the result of sudden changes of acceleration and motion including changes in direction and speed such as are normally encountered in many physical activities, for example, running, jogging, jumping, physical contact sports and combat, falling and the like.

"Inertially-induced movement" means movement between a knife sheath and a contained knife due to inertially-induced forces.

"Rigid but resilient thermoplastic" or "rigid-resilient thermoplastic" means a thermoplastic of any chemical composition having, at room temperature, the general physical characteristics such as hardness, modules of elasticity and the like of "Kydex®" 100 thermoplastic sheet as described herein. Such material should also be thermoformable, although the conditions of thermoformability need not necessarily be the same as those as for Kydex® material sold by Kleerdex Industries.

"Accouterments" is used in its broadest sense of clothing or dress and includes in particular, any part of the dress of a human or the equipment of an outdoorsman or military or civil official or other member of the public. An upper edge of an accouterment can and should be understood to include the upper edge of a pocket, of a belt, or of a pair of trousers or other upstanding edge having both a front and backside and over which a clip or the like may be slipped.

"Secured effectively together" means attached together in a secure fashion such as by use of fastenings, including but not restricted to rivets, bolts, screws, screw-and-post arrangements, interlocking arrangements, sewing, including interweaving and binding with thongs and the like as well as adhesion through the use of general adhesives as well as intermingling of the same substance at elevated temperatures or as a solute or in a solvated state or form induced either by elevated temperatures or by dissolving in a solvent and includes as well, being integral therewith as when two pieces are connected by an integral connecting member.

"Resilient cushioning" means a flexible or resilient padding or cushioning that will effectively encompass and envelop the outer contours of at least one side of an object and will, if a force is applied to one side of said resilient cushioning, tend to transfer at least a portion of said force more or less uniformly to all surfaces of said material.

"Thermoforming pressure" means a pressure-type force applied to the surface of an object raised or held at a temperature significantly elevated with respect to normal room temperature for applying more or less uniform pressure over a surface for molding an underlying plastic material. Such pressure may be transferred to the surface by resilient cushioning, by fluid pressure, including hydrostatic and gas pressure, and by other means.

"Means for support" means, when applied to a knife sheath or the like, various clips, loops, thongs, ties and other attachments by which such sheath may be secured to accouterments of the human body through any portion of the sheath.

"Pocket retention clip" means a member intended to be inserted inside a pocket to support or retain a second member attached thereto outside such pocket.

"Semirigid" means stiff but flexible, or in other words, a member which is fairly stiff and constant in configuration at normal temperatures, but which can be deflected at least somewhat by sufficient pressure without substantial risk of fracture, at least until a major deflection has been effected and is used particularly with reference to materials suitable for use as pocket retention clips.

"Bulk stabilizing" or "bulk stabilization" means, with respect to a clip or other support-detent like member inserted into a pocket, that the clip or other support-detent has dimensions relative to the pocket such that the clip or detent sufficiently fills such pocket laterally to prevent substantial lateral movement within said pocket thus stabilizing, with respect to such pocket, the position of the clip or support detent relative to the cloth or other accouterments upon or in which the pocket is positioned.

"Inversely increasing dimension section" and "inversely dimensioned section" means a section of preferably the lower portion or bolster of a knife handle which increases in transverse dimensions a small amount on one or both sides equally or unequally toward the point of the knife and serves, when a plastic section of a sheath is thermomolded to the knife, to interlock the sheath with the knife and require a finite amount of force to force the plastic to resiliently move to the side to release the inversely increasing dimension section from interengagement with the mirror image section of the sheath.

"Resilient biasing friction member" or "resiliently biased member or portion" means a member or means which is biased by its own resiliency and shape against another member to place frictional force against movement of such member past the biasing member.

"Resilient gripping arrangement" means an arrangement in which a resilient plastic material passes about a member and grips such member as a result of resilient spring back of such plastic after the member is forced within the gripping radius of the plastic material.

"Bolster" means a metal section near the center of a knife from top to bottom usually having dimensions most closely resembling the original dimensions of the knife blank from which the knife was formed and forming functionally, in most cases, the bottom portion of the handle.

While the present invention has been described at some length and with some particularity with some respect to several described embodiments, it is not intended that it should be limited to any such particulars or embodiments or any particular embodiment, but is to be construed broadly with reference to the appended claims so as to provide the broadest possible interpretation of such claims in view of the prior art and therefore to effectively encompass the intended scope of the invention.

I claim:

1. A knife sheath adapted for securely gripping a knife having a hilt and a knife blade to prevent nonvoluntary separation of said knife from within said sheath, said sheath comprising:

(a) two opposite sheath walls formed of a substantially rigid yet resilient plastic resin material, said sheath walls being arranged and constructed such that said walls are adapted to encompass said knife blade therebetween, (b) said opposite sheath walls being secured together along substantially intersecting edges, (c) said opposite sheath walls being heat molded to conform to at least a substantial portion of said knife blade and a portion of the hilt such that the sheath is adapted to grip said knife blade and a portion of said hilt inserted thereinto sufficiently tightly to retain said knife and prevent gravitationally-induced separation if oriented in an inverted position, and (d) a resilient gripping arrangement on said sheath and being adapted for secondary resilient contact with said hilt of said knife when inserted into the sheath, and (e) means for supporting said sheath on a user, said means for supporting being secured to the sheath adjacent to a lower end of the sheath and comprising a semirigid clip in the form of a generally rectangular semirigid sheet adapted for insertion into and bulk stabilization of the clip in a pocket of clothing on a user such that said sheath and said knife contained therein are oriented in an inverted position and dependent from said clip, the semirigid sheet of the clip extending substantially parallel to one of said opposite sheath walls whereby when the clip is inserted into a pocket, a rear portion of the sheath and a side of the hilt of said knife retained in the sheath are adapted to lie against a front portion of a pocket in which the clip is contained.

2. A knife sheath in accordance with claim 1 wherein the sheath has been thermomolded about a lower portion of the hilt of said knife which constitutes a bolster of said knife.

3. A knife sheath in accordance with claim 2 wherein the material of the sheath has been thermomolded for later gripping a bolster of a knife inserted into the sheath which bolster changes in dimension smoothly and at most at a rate and amount which is barely perceptible to the naked eye, such change constituting an increase in dimensions away from the handle of the knife.

4. A knife sheath in accordance with claim 3 wherein said resilient gripping arrangement includes a resiliently biased portion adapted to contact one side of the hilt of said knife when the knife is inserted into the sheath to frictionally aid in retaining the knife in the sheath.

5. A knife-and-sheath combination comprising:

(a) a sheath having two opposite walls formed of a substantially rigid yet resilient plastic thermoformable resin material, (b) a knife having a knife blade and handle, said blade being inserted between said opposite walls of said sheath, (c) said walls of said sheath being securely fastened together along at least two edges of each wall, (d) said opposite walls being heat molded to conform to at least a substantial portion of the knife blade and a portion of the handle such that the two walls of the sheath grip the knife sufficiently tightly to retain and prevent separation of said knife from said sheath when said sheath is in an inverted position, (e) said walls of the sheath being secured substantially at a lower end to a generally rectangular semirigid, substantially flat member adapted to be inserted into a pocket of an item of dress worn upon a user such that the knife and sheath are maintained in an inverted position and the flat member extends substantially parallel to one of said opposite sheath walls along at least a portion of the sheath, and (f) wherein the generally rectangular semirigid member is of a size to bulk stabilize such rectangular semirigid member in said pocket.

6. A knife-and-sheath combination in accordance with claim 5 wherein an inversely dimensioned portion of the handle comprises an inversely increasing dimension on a bolster of the knife.

7. A knife-and-sheath combination in accordance with claim 6 wherein the bolster of the knife changes in dimension smoothly and at most at a rate and amount which is barely perceptible to the naked eye, such change constituting an increase in dimensions away from the handle of the knife.

8. A knife-and-sheath combination in accordance with claim 7 additionally comprising a resilient extension of one of said walls of the sheath, said extension being adapted to bear against a side of the handle of the knife.

9. A knife sheath adapted for securely gripping a knife having a hilt and a knife blade to prevent non-voluntary separation of said knife from within said sheath, said sheath comprising:

(a) two opposite walls formed of a substantially rigid yet resilient plastic resin material, said sheath walls being arranged and constructed such that said walls are adapted to encompass said knife blade therebetween, (b) said opposite sheath walls being secured together along substantially intersecting edges, (c) said opposite sheath walls being heat molded to conform to at least a substantial portion of said knife blade such that the sheath is adapted to grip said knife blade inserted thereinto sufficiently tightly to retain said knife and prevent gravitationally-induced separation, if the sheath is oriented in an inverted position, and (d) a resilient gripping arrangement on said sheath and being adapted for secondary resilient contact with said hilt of said knife when inserted into the sheath, (e) means for supporting said sheath on a user, said means for supporting being attached to said sheath and (f) wherein said resilient gripping arrangement is a resiliently biased extension on the sheath adapted to contact the hilt of the knife when said knife is inserted into said sheath, said extension being formed from a portion of one of said opposite sheath walls and including an S-shaped curved portion molded therein, wherein said curved portion is positioned adjacent said supporting means and biases said hilt away from said supporting means.

* * * * *